US007976654B1

(12) United States Patent
Stec, III et al.

(10) Patent No.: US 7,976,654 B1
(45) Date of Patent: Jul. 12, 2011

(54) HIGH EXPLOSIVE FILLS FOR VERY SMALL VOLUME APPLICATIONS

(75) Inventors: Daniel Stec, III, Long Valley, NJ (US); Gartung Cheng, Edison, NJ (US); Brian E. Fuchs, Hackettstown, NJ (US); Gerard Gillen, Milford, PA (US); Neha Mehta, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 82 days.

(21) Appl. No.: 12/504,988

(22) Filed: Jul. 17, 2009

Related U.S. Application Data

(63) Continuation-in-part of application No. 10/248,904, filed on Feb. 28, 2003, now Pat. No. 7,052,562.

(51) Int. Cl.
*C06B 45/00* (2006.01)
*D03D 23/00* (2006.01)
*D03D 43/00* (2006.01)

(52) U.S. Cl. ... 149/109.6; 149/2; 149/108.6; 149/108.8; 149/109.4

(58) Field of Classification Search ..... 149/2, 108.6, 149/108.8, 109.4, 109.6
See application file for complete search history.

(56) References Cited

U.S. PATENT DOCUMENTS 3,652,497 A * 3/1972 Junas et al. ..... 525/328.8
5,565,150 A * 10/1996 Dillehay et al. ..... 264/3.3
6,171,530 B1 * 1/2001 Haaland et al. ..... 264/3.2
7,597,046 B1 * 10/2009 Laib ..... 102/202.5

* cited by examiner

*Primary Examiner* — James E McDonough
(74) *Attorney, Agent, or Firm* — Henry S. Goldfine

(57) ABSTRACT

High explosives suitable for filling very small volume loading holes in micro-electric initiators for micro-electro-mechanical mechanisms, used as safe and arm devices, are prepared from slurries of crystalline energetic materials including organic liquid and applied using various methods. These methods include swipe loading, pressure loading and syringe loading. The organic liquid serves as a volatile mobile phase in the slurry so as to partially dissolve the energetic material so that, upon evaporation of the mobile phase, the energetic material precipitates and adheres to the loading hole.

22 Claims, 3 Drawing Sheets

HIGH EXPLOSIVE FILLS FOR VERY SMALL VOLUME APPLICATIONS

CROSS REFERENCE TO RELATED APPLICATIONS

This application is a continuation-in-part of application Ser. No. 10/248,904 filed Feb. 28, 2003 now U.S. Pat. No. 7,052,562 by Daniel Stec, III, et al., the entire file wrapper contents of all of which application is hereby incorporated by reference as though fully set forth.

FEDERAL RESEARCH STATEMENT

[The inventions described herein may be manufactured, used and licensed by or for the U.S. Government for U.S. Government purposes.]

BACKGROUND OF INVENTION

1. Field of the Invention

The present invention relates to methods for preparing and using energetic fills containing crystalline high explosive materials.

2. Related Art

The basic standard methods for loading energetic or explosive materials into munitions are press-loading, and cast loading (whether using melt-cast or cast-cure techniques). With the relatively recent emergence of the production of smart weapon systems that are lighter and smaller and have greater lethality and survivability, the need exists for smaller, reliable Safe and Arm (S&A) devices for activating the explosive train of the explosive device. The challenges in producing Micro-Energetic Initiators (MEI) for Micro Electro-mechanical Mechanisms (MEMS) as safe and arm devices, involve the need to introduce the energetic materials into extremely small volumes and to have the energetic materials function properly after such introduction. MEIs for safe and arm devices will necessarily be smaller in size and weight than traditional fuzing devices, and will permit a larger loading of the energetic fill of the end item, thereby resulting in increased lethality. The standard loading methods mentioned above cannot be used to load the very small (microliter) volumes contained in these devices.

Considering the latter point in more detail, as indicated previously, the standard methods for loading an energetic fill into a munition are press-loading and cast-loading. With respect to the former, delivering the material to the fixture, followed by consolidation thereof by pressing, presents difficulties because of the very small required volume of the solids. Further, because of the delicateness of the materials of construction of the critical fixture, press loading of the energetic fill into the fixture is not a viable option. One potential approach would be to prepare a pellet of the energetic material externally of the fixture, and then load the pellet into the fixture. To complete the process, in order to maintain the pellet in place, some kind of adhesive would have to be applied to the pellet, e.g., on the side thereof, or to the wall of the fixture. It will be appreciated that such a process would be cumbersome and relatively costly.

As was also mentioned previously, casting of an energetic fill into a fixture can be done either by melt casting and cast curing. Melt casting basically entails heating a substance to a temperature above its melting point, adding any needed ancillary materials to the melt, pouring the mixture into the volume to be filled, and allowing the fill to solidify in place. Among other problems with this approach, because of the very small delivery volumes involved in producing MEIs for safe and arm devices, heat loss to the ambient environment would be a problem and, in this regard, could cause the energetic material to solidify before being emplaced.

Cast curing basically entails mixing the substance to be cast in a liquid polymer mixed with a cross-linking reagent. The resultant cast mixture has a finite "pot life" after which the viscosity of the mixture increases because of the chemical crosslinking process. This change in rheological properties may cause difficulty in the delivery into the fixture of energetic material prepared in this way.

There are, of course, a number of state-of-the-art delivery devices for the delivery of small volumes of materials including ink jet printing. The latter is a mature technology that can be used to accurately deliver small volumes of material. However, the present technology is unsuitable for delivering energetic materials for two reasons. First, most inks used for ink jet printing are dye-based, i.e., the colorant dye is dissolved in the fluid medium, and although there are pigment-based ink jet inks available wherein the colorant is an undissolved crystalline material, the undissolved solids are of a sub-micron particle size. Important secondary high explosives such as CL-20 (epsilon HNIW) are not presently available in a sub-micron particle size. Further, in an ink jet printer, the ink is typically delivered from the print head by a piezoelectric discharge that ejects droplets of ink at elevated pressure and temperature onto the printing substrate; the combination of an electric discharge and high temperature/pressure may be a safety hazard when attempting to deliver energetic materials using ink jet printing.

SUMMARY OF INVENTION

As indicated above, the present invention is concerned with loading crystalline high explosive materials into small volume munitions and is especially concerned with MEMs/MEI "micro" region explosive initiation trains. As will appear, the methods of the invention serve to overcome the problems discussed above in connection with loading crystalline high explosive materials into small volumes.

Before considering the invention in more detail, a further loading method of particular interest here is one used exclusively for primary explosives. As will be understood by those familiar with this field, a distinction is drawn between primary explosives (e.g., lead styphnate and the like) which are high power highly sensitive explosives that may detonate in response to a small "insult" and secondary explosives which are of lower power and require a strong shock to detonate, a shock which is typically provided by a primary explosive. Primary explosives in small quantities have been ground up wet and added to a slurry which is, e.g., deposited on a bridgewire. With secondary explosives, the typical applications are large volume applications such as munitions wherein the secondary explosive is the main energetic fill, and wherein maximum power or performance is desired. An important figure of merit in determining performance is the % Theoretical Maximum Density (TMD). The aim is that this percentage should be as high as possible because cracks, porosity and the like reduce the power/performance of the secondary explosive and also, undesirably, increase the sensitivity of the explosive. As a result, secondary explosive formulations are normally cast or pressed into final or near-final shape as described above because if such formulations were to be loaded as a slurry into a large volume munition, the drying time (for evaporation of the slurry medium) would be excessively long and the volatile medium would have to diffuse through dried material potentially causing defects in the fill such as porosity, voids, cracks, entrapped slurry medium and the like. These defects would result in safety and performance problems and thus, slurry loading has not been used for secondary explosives.

The present invention is based, in part, on the inventive appreciation that, despite the serious potential problems with slurry loading of secondary explosives, such an approach can be used to great advantage in small volume applications. The surprising finding has been that in such an approach, even though the resulting fill has a lower % TMD than if pressed or cast and thus has an attendant increase in the number of defects, the evaporation takes place in a straightforward manner, the resultant solid fill has the physical strength and integrity essential for proper functioning of the loaded item, and, quite unexpectedly, the resultant increase in defects does not have a deleterious effect on the energetic performance in the MEM scale. In the latter regard, despite the density decrease, the energetic performance of the fill has been found to be much better than would normally be expected.

In accordance with a first aspect of the invention, there is provided a method for loading crystalline energetic materials into small volume loading hole of a fixture of an explosive device, said method comprising the steps of:

preparing a slurry or paste containing the crystalline energetic material; and loading the slurry or paste containing the crystalline energetic material into the loading hole of the fixture of the explosive device.

In one preferred embodiment, the step of loading the slurry or paste comprises placing the slurry or paste on a blade member and wiping the blade member over the fixture so as to force the slurry or paste into the loading hole in the fixture.

In another preferred embodiment, the step of loading the slurry or paste comprises placing the paste or slurry in a contained space having an outlet orifice therein, and dispensing the paste or slurry through the orifice into the hole in the fixture.

In one preferred implementation of this embodiment, the method employs a pipette for dispensing the paste or slurry. In another preferred implementation, the method employs a syringe for dispensing the paste and slurry and a plunger of the syringe is used to force the paste or slurry, through the orifice. In yet another implementation, the method employs a pump for dispensing the paste or slurry. Advantageously, the pump comprises a positive displacement pump. In another advantageous approach, the pump comprises a peristaltic pump.

Preferably, the method further comprises incorporating at least one volatile mobile phase to the paste or slurry so as to partially dissolve the energetic material such that, upon evaporation of the at least one mobile phrase, the dissolved energetic material precipitates and thus adheres to a portion of the fixture forming the loading hole.

In another preferred implementation, the method further comprises incorporating a polymeric binder into the slurry or paste so as to provide adherence between crystals of the polycrystalline energetic material and a portion of the fixture forming said loading hole. The amount of binder preferably ranges between 0.01 and 10 wt. % of the energetic material. Advantageously, the binder is dissolved in the slurry or paste. In another advantageous approach, the binder is incorporated into the slurry or paste as a latex suspension. In yet another advantageous approach, the binder is incorporated into the slurry or paste as an emulsion.

In another advantageous implementation, the crystalline energetic material comprises CL-20 and a mixture of ethanol and ethyl acetate is used as a liquid for the slurry. Preferably, the mixture is in the range of 90:10 to 60:40 volume/volume percent.

Advantageously, the method further comprises incorporating a polymeric binder into the slurry or paste to modify the viscosity of the mobile medium and improve the physical strength of the slurry or paste.

In another advantageous implementation, the method further comprises incorporating a plasticizer, either energetic or non-energetic, into the slurry or paste to produce an increase in adhesive strength and flexibility.

Preferably, a binder system is added to the slurry or paste which is selected from the group of polyvinyl alcohol/polyvinyl ester copolymers, polyacrylates, polymethacrylates, poly(vinyl pyrrolidone/vinyl alcohol) copolymers, ethylene-vinyl alcohol/acetate terpolymers, polyurethanes, styrene-maleic anhydride copolymers, styrene-acrylic copolymers, epichlorohydrin-based polymers, oxetane-based polymers, substituted celluloses such as ethyl cellulose and nitrated cellulose derivatives, including the energetic polymers GAP and polyGLYN and oxetane-based polymers such as polyBAMO, polyAMMO, BAMO-AMMO copolymers, and polyNIMMO.

The high explosive material is preferably selected from the group consisting of CL-20, HMX, RDX, TNAZ, PETN, HNS, and the like.

In accordance with a further aspect of the invention there is provided a slurry of a secondary high explosive material in a volatile mobile phase for delivery to a loading hole in a fixture for an explosive device.

Further features and advantages of the present invention will be set forth in, or apparent from, the detailed description of preferred embodiments thereof which follows.

DETAILED DESCRIPTION

Figure 1:
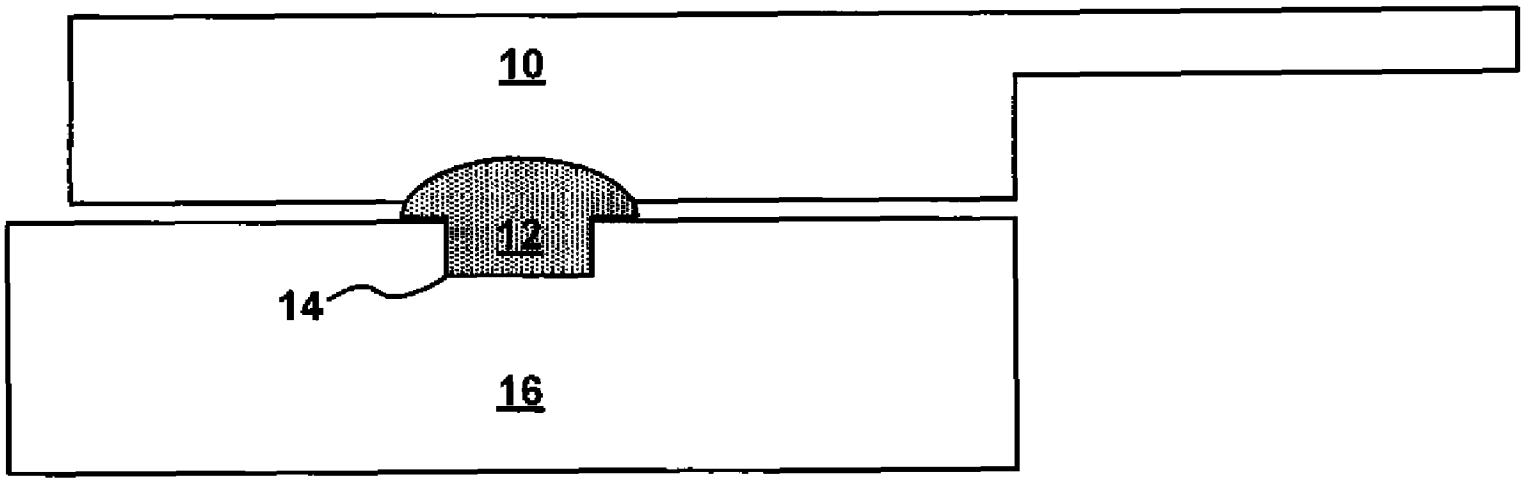
FIG. 1 is a schematic side elevational view, partially in section, of an energetic fill slurry delivery system in accordance with a first embodiment of the invention.

As indicated above, the present invention is particularly concerned with MEMs-based safety and arming devices. It will be understood that a MEMs (mechanical) S&A is not a "sensor" device per se but rather a device wherein the components thereof intrinsically combine both "sense" and "actuate" functions in a single unpowered chip. Although the invention is obviously not limited to use with a particular device, an example of such a device is disclosed in U.S. Pat. No. 6,167,809, which is hereby incorporated by reference. Devices of this kind can include a transfer charge as well as conventional primary explosives upstream of the transfer charge, with all other explosives, including the transfer charge, being secondary explosives. As discussed above, loading of secondary explosives into the very small volumes associated with the fixtures of MEMs S&A devices presents special problems.

As is believed to be evident from the foregoing, in order to provide a MEMs safe and arm device that performs reliably, despite the small volume thereof, it is essential that the explosive fill used have a high energetic output and a small critical diameter. One explosive fill that meets both requirements is CL-20 (epsilon HNIW), although as discussed below, a number of other fills, such as HMX, RDX, TNAZ, PETN, HNS and others, including all crystalline polymorphs, are also excellent candidates. These other energetic fills are well known in the art and, for example, TNAZ is 1,3,3-trinitroazetidine.

As indicated above, in accordance with an important feature of the invention, the energetic fill material is prepared as a slurry, and a number of different liquids can be used as the mobile phase, which can be aqueous or organic in nature. In one preferred embodiment, organic liquids are used as the mobile phase and, more preferably, the organic liquid used is selected from the group consisting of ethanol, isopropanol, texanol. and the like, and a mixture of one alcohol and an ester or ketone, such as ethyl acetate, two alcohols, although other mutually soluble organic liquids can be used. In this regard, CL-20 has low solubility in the alcohols and high solubility in ethyl acetate and the solubility of the energetic fill material can be controlled by adding alcohol to the slurry liquid. Again, it will be appreciated by those skilled in this art that a variety of different liquids can be used and the solubility of the explosive fill can be tailored using different liquids in order to meet the needs of the actual system into which the energetic fill material is to be loaded.

In one important embodiment, the energetic material, e.g., CL-20, is placed in a conductive container, the slurry liquid is added in a dropwise manner, i.e., drop by drop, with a stirring or mixing implement until a paste is obtained. The stirring or mixing implement is preferably made of a metal, conductive plastic, PTFE or the like.

Once the paste of energetic material is produced, a number of different methods can be used to load the paste into the small volume opening of the safe and arm fixture.

In accordance with a loading method in accordance with one important implementation of the invention, the energetic material in the form of a paste is loaded using a swipe loading technique wherein the paste is taken up on a spatula or other wiping element and is swiped or wiped over the hole or opening to be filled. Referring to FIG. 1, a spatula or other blade or wiping element is denoted 10 and a paste including an energetic material is indicated at 12. By wiping element 10 over a hole 14 in a fixture 16, the hole 14 can be filled with the paste 12, as shown.

Figure 2:
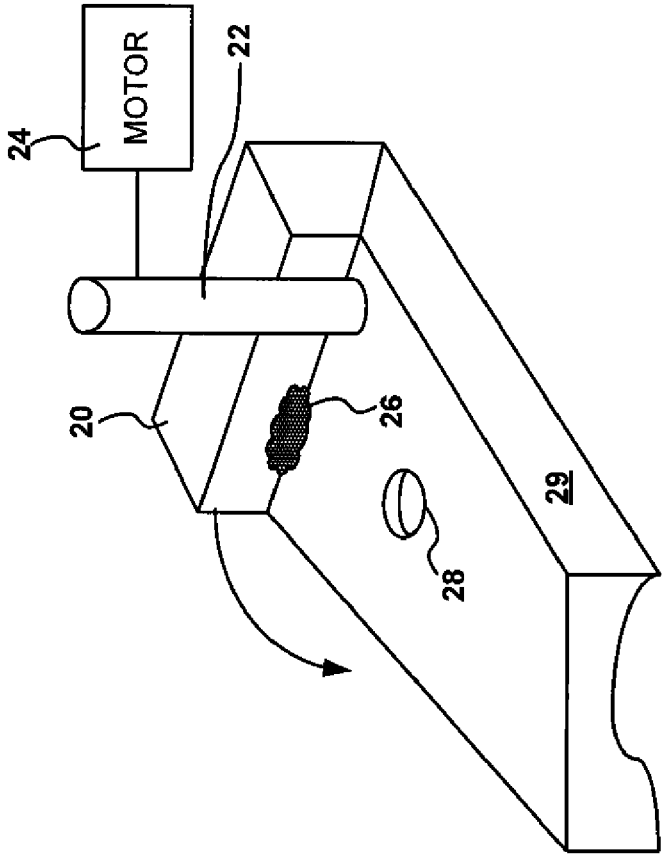
FIG. 2 is a schematic perspective view of an energetic fill slurry delivery system in accordance with a further embodiment of the invention.

It will be appreciated that wiping element can also be part of an automatic wiping apparatus. As shown schematically in FIG. 2, a pivotable blade 20, which is affixed to a rotatable shaft 22 driven by a motor 24, can be used to wipe the energetic fill paste 26 across a loading hole 28 in a fixture 29. It will also be appreciated that the energetic material, denoted 20, can be in a looser slurry form, rather than a paste, and still be forced or dispensed into the volume to be filled.

A specific non-limiting example of this implementation is also discussed below in Example 1.

Figure 3:
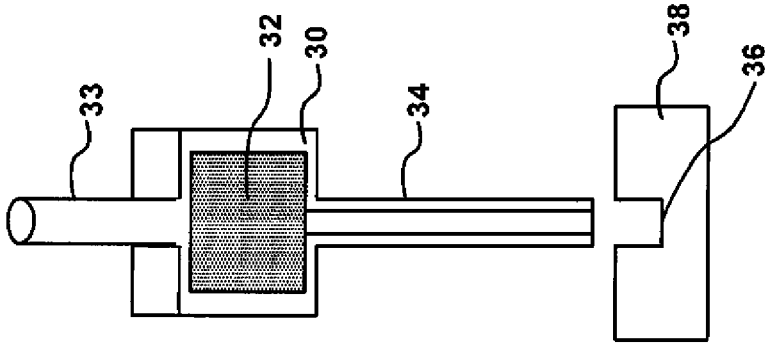
FIG. 3 is a schematic side elevational view, partially in section, of an energetic fill slurry delivery system in accordance with another embodiment of the invention.
Figure 4:
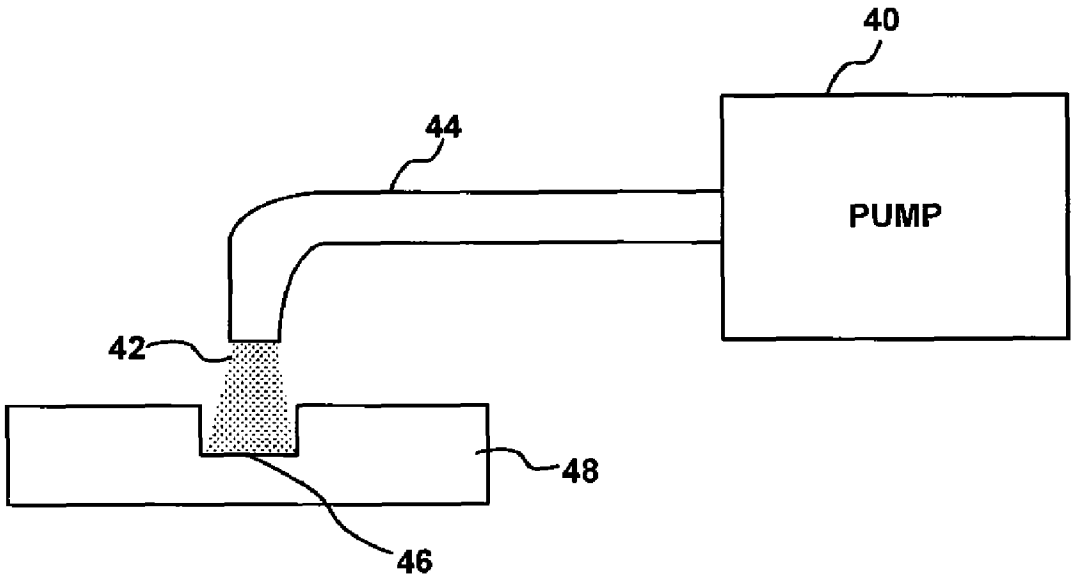
FIG. 4 is a schematic side elevational view of an energetic fill slurry delivery system in accordance with yet another embodiment of the invention.

A loading method in accordance with a further embodiment of the invention involves pressure loading of the energetic material, wherein, broadly speaking, a slurry or paste of energetic material is placed into a container and forced through an orifice in the container into a loading hole in a fixture. This method is illustrated schematically in FIG. 3 which shows a container 30 that is filled with a slurry or paste 32 of energetic material, and that includes a plunger 33. Container 30 also includes an outlet orifice or opening 36. Depressing of plunger 33 causes the energetic material 32 to be expressed out of orifice 34 into a loading hole 36 in a fixture indicated schematically at 38. It will be appreciated that a number of different pressure-loading devices can be used including, for example, pipettes, syringes, and various pumps, including peristaltic and positive-displacement pumps. The latter approach is illustrated schematically in FIG. 4 which shows a pump 40 for receiving energetic material 42 in a paste or slurry form and for pumping the energetic material 52 through a delivery tube 44 into loading hole 46 in a fixture 48.

In an important implementation using CL-20, the slurry liquid is a mixture of ethanol and ethyl acetate and, preferably, the mixture is 90:10 to 60:40 volume/volume percent.

The physical integrity of the loaded energetic fill material can be substantially improved by dissolving a polymer in the mobile phase prior to slurrying of the energetic fill material. In an important implementation, wherein the energetic fill material was CL-20, the polymer coated the CL-20 as well as the metal/plastic surfaces of the loaded fixture when the mobile liquid phase evaporated. A binder loading as low as 0.01-0.5 weight percent with respect to explosive fill, was found to improve the physical integrity of the loaded CL-20 without degrading or interfering with its energetic performance.

A wide range of polymers can be used for the purposes just described and both non-energetic and energetic polymers can be used. Suitable binder systems include polyvinyl alcohol/polyvinyl ester copolymers, polyacrylates, polymethacrylates, polyvinyl pyrrolidone/vinyl alcohol) copolymers, ethylene-vinyl alcohol/acetate terpolymers, polyurethanes, styrene-maleic anhydride copolymers, styrene-acrylic copolymers, epichlorohydrin-based polymers, oxetane-based polymers, substituted celluloses such as ethyl cellulose and nitrated cellulose derivatives. Energetic polymer systems that can be used include GAP, polyGLYN and oxetane-based polymers such as polyBAMO. AMMO, BAMO-AMMO copolymers, and polyNIMMO. The latter are well known energetic polymers and, for example, BAMO is 3,3-bis-azidomethyl-oxetane while AMMO is 3-azidomethyl-3-methyloxetane, and the oxetane thermoplastic elastomer energetic binder is available from Thiokol Corporation.

A plasticizer can be used along with the binder to improve the adhesive strength and flexibility of the dried energetic material.

Example 1

A small amount of a CL-20 slurry, prepared as described above, was taken up on a PTFE spatula and wiped over a loading hole in a fixture of an explosive device (as in FIG. 1). The mobile phase was allowed to dry. A loading hole in a second fixture was loaded with lead azide. Upon drying of the slurry mobile phase, an electrical resistance bridgewire was placed in direct contact with the lead azide and connected to the terminals of a battery. The CL-20 energetic material was successfully functioned.

Example 2

A fixture was provided comprising a plate (made of PMMA or aluminum) having a hole drilled through the plate and a trough inscribed on the plate surface so as to be in communication with the hole. CL-20 was incorporated in a slurry with ethanol, and loaded into the hole in the plate with a small volume of the slurry placed in the trough. In addition, lead styphnate was placed in the trough in direct contact with the CL-20 and so as to partially fill the trough. Lead azide was then placed in the trough to fill the remaining trough volume. An electrical resistance bridgewire was placed in direct contact with the lead azide and the bridgewire was connected to the terminals of a battery. The device was successfully functioned and, in this regard, the primary explosives, lead styphnate and lead azide, set off the CL-20 fill material, which carried out a 90° corner turn and made a dent in a lead witness plate disposed in the end of the explosive train. In a closely related example, the device also functioned without the inclusion of lead styphnate in the explosive train.

Example 3

A fixture plate made of PMMA or aluminum having a hole drilled through the plate thickness was provided and the hole was loaded as in Example 1. The device was successfully functioned using a low voltage electric bridgewire, with lead azide being used as the primary initiating explosive.

Example 4

A slurry of CL-20 prepared as in Example 1 was thinned with a few drops of EtOH and taken up in a disposable Pasteur pipette. The tip of the pipette was placed over the loading hole of a fixture plate (as described above) and the bulb of the pipette was squeezed so that a small amount of the thinned slurry was injected into the hole in the fixture.

Example 5

A slurry of CL-20 as described above was thinned with a few drops of EtOH and taken up in a disposable Pasteur pipette. The tip of the pipette was placed in the barrel of a plastic 1-ml syringe. A disposable 18-gauge stainless steel needle, cut down in length to 0.5 inches, was attached to the barrel of the syringe. The aforementioned slurry was loaded into the syringe and the syringe plunger was placed in the barrel. The tip of the needle was positioned over the loading hole in the fixture, the plunger depressed and the required amount of slurry containing the energetic material was injected into the hole in the fixture.

Example 6

An aluminum plate having a through hole therein was prepared. The hole was loaded with a CL-20 slurry as in Examples 1, 4 and 5. Lead azide was placed over the CL-20 slurry and the resultant device was successfully functioned using a low voltage electric bridgewire connected to a battery. Further, a plate prepared as above, and loaded as above, was placed over a second plate or another plate as described above, also loaded with CL-20. The upper plate of the resultant device was functioned and the detonation was successfully transferred from the upper initiating plate to the item placed under the upper plate, resulting in a dent in a lead witness plate.

Example 7

A 70:30 weight/weight texanol (2,2,4-trimethyl-1,3-pentanediol monoisobutyrate, Eastman Chemical)/ethanol mixture was prepared. To 4.5 grams of the solution was added 0.5 grams ethyl cellulose (ETHOCEL, Dow Chemical.) The mixture was stirred until the solids had dissolved. Dry CL-20 (9.5 g) was added portionwise with mixing to the solution. A thick, smooth paste was obtained. The formulation was loaded into a disposable syringe and dispensed onto a piece of aluminum. The formulation flowed smoothly and adhered to the metal. The piece of aluminum was elevated to a temperature of 55° C. to facilitate drying of the formulations.

Although the invention has been described above in relation to preferred embodiments thereof, it will be understood by those skilled in the art that variations and modifications can be effected in these preferred embodiments without departing from the scope and spirit of the invention.

What is claimed is:

1. A method for loading crystalline energetic material into a small volume loading hole of a fixture of a MEMs safety and arming device fabricated on a die approximately one square centimeter or less in area, said method comprising the steps of:

preparing a slurry or paste containing the crystalline energetic material;

loading the slurry or paste containing the crystalline energetic material into the loading of the fixture of the explosive device wherein the crystalline energetic material comprises high explosive material and an organic liquid for the shiny or paste.

2. A method according to claim 1, wherein the step of loading the slurry or paste comprises placing the slurry or paste on a blade member and wiping the blade member over the fixture so as to force the slurry or paste into the loading hole in the fixture.

3. A method according to claim 1, wherein said step of loading the slurry or paste comprises placing the paste or slurry in a contained space having an outlet orifice therein, and dispensing the paste or slurry through the orifice into the hole in the fixture.

4. A method according to claim 3, wherein the method employs a pipette for dispensing the paste or slurry.

5. A method according to claim 3, wherein the method employs a syringe for dispensing the paste and slurry and a plunger of the syringe is used to force the paste or slurry through the orifice.

6. A method according to claim 3, wherein the method employs a pump for dispensing the paste or slurry.

7. A method according to claim 6, wherein said pump comprises a positive displacement pump.

8. A method according to claim 6, wherein said pump comprises a peristaltic pump.

9. A method according to claim 1, wherein the organic liquid serves as a volatile mobile phase to the paste or slurry so as to partially dissolve the energetic material such that, upon evaporation of the at least one mobile phase, the dissolved energetic material precipitates and adheres to a portion of the fixture forming the loading hole.

10. A method according to claim 1, further comprising:

incorporating a polymeric binder into the slurry or paste so as to provide adherence between crystals of the polycrystalline energetic material and a portion of the fixture forming said loading hole.

11. A method according to claim 10, wherein the amount of binder ranges from between 0.01 and 10 wt. % of the energetic material.

12. A method according to claim 11, wherein the binder is dissolved in the slurry or paste.

13. A method according to claim 11, wherein the binder is incorporated into the slurry or paste as a latex suspension.

14. A method according to claim 11, wherein the binder is incorporated into the slurry or paste as an emulsion.

15. A method according to claim 1, wherein the organic liquid comprises a mixture of ethanol and ethyl acetate serving as the liquid component for the slurry.

16. A method according to claim 15, wherein the mixture of ethanol and ethyl acetate is 90:10 to 60:40 volume/volume percent.

17. A method according to claim 1, further comprising incorporating a polymeric binder into the slurry or paste to enhance the physical strength of the slurry or paste.

18. A method according to claim 1, further comprising incorporating a plasticizer binder into the slurry or paste to produce an increase in adhesive strength and flexibility.

19. A method according to claim 1, wherein a binder system is added to the slurry or paste which is selected from the group polyvinyl alcohol, polyvinyl alcohol/polyvinyl A ester copolymers, polyacrylates, casein, polyvinyl alcohol/polyvinyl pyrrolidone copolymers, polyvinyl pyrrolidone, substituted polyvinyl pyrrolidone, ethylenevinyl alcohol/acetate terpolymers, polyurethanes, styrene-maleic anhydride copolymers, and styrene-acrylic copolymers, epichlorohydrin-based polymers and oxetane-based polymers.

20. A method according to claim 19, wherein said epichlorohydrin-based polymers include the energetic polymers GAP and polyGLYN.

21. A method according to claim 19, wherein the oxetane-based polymers include polyBAMO, polyAMMO, BAMO-AMMO copolymers, and polyNIMMO.

22. A method according to claim 1, wherein said high explosive material is selected from the group consisting of CL-20, HMX, RDX, TNAZ, PETN, HNS, and all crystalline polymorphs.

* * * * *